US011987467B2

(12) United States Patent
Perla

(10) Patent No.: US 11,987,467 B2
(45) Date of Patent: May 21, 2024

(54) ROLLED PAPER CUTTING DEVICE

(71) Applicant: Bryan Perla, West Boylston, MA (US)

(72) Inventor: Bryan Perla, West Boylston, MA (US)

( * ) Notice: Subject to any disclaimer, the term of this patent is extended or adjusted under 35 U.S.C. 154(b) by 0 days.

(21) Appl. No.: 17/721,308

(22) Filed: Apr. 14, 2022

(65) Prior Publication Data

US 2023/0042565 A1 Feb. 9, 2023

Related U.S. Application Data

(63) Continuation-in-part of application No. 15/994,665, filed on May 31, 2018, now abandoned.

(60) Provisional application No. 62/670,840, filed on May 13, 2018, provisional application No. 62/513,474, filed on Jun. 1, 2017.

(51) Int. Cl.
*B65H 35/06* (2006.01)

(52) U.S. Cl.
CPC ... *B65H 35/06* (2013.01); *B65H 2301/51512* (2013.01)

(58) Field of Classification Search
CPC ..... B65H 2301/515; B65H 2301/5151; B65H 2301/51512; B65H 2301/51513; B65H 2301/515126; B65H 2301/515123; B65H 2701/1944; B65H 35/002; B65H 35/06; B65D 83/0882; B65D 83/0841; B26B 3/08; B26B 29/06; B26D 1/04; Y10T 225/257; Y10T 225/256
USPC ..... 30/124
See application file for complete search history.

(56) References Cited

U.S. PATENT DOCUMENTS 4,886,198 A * 12/1989 de Larosiere ..... B41L 1/14 400/621.1
2009/0254081 A1* 10/2009 Allison ..... A61B 18/1442 29/469
2015/0059188 A1* 3/2015 Haas ..... B26B 3/08 30/279.2

FOREIGN PATENT DOCUMENTS

DE 202012006366 U1 * 11/2013 ..... B26B 27/00

* cited by examiner

*Primary Examiner* — Jennifer S Matthews
(74) *Attorney, Agent, or Firm* — Schaffer IP Law, LLC

(57) ABSTRACT

The present invention is a rolled paper cutting device and method which safely and easily cuts a variable length sheet of paper from rolled paper, including an adjustable holder for controlling the rolled paper, and a paper cutting blade embedded within a safety slot, the safety slot protecting a user from a blade related injury.

14 Claims, 13 Drawing Sheets

ROLLED PAPER CUTTING DEVICE

CROSS-REFERENCE TO RELATED APPLICATIONS

This application claims the benefit under 35 U.S.C. § 120, as a Continuation-in-Part, of U.S. patent application Ser. No. 15/994,665 filed May 31, 2018, and also, claims the benefit under 35 U.S.C. § 119(e) of U.S. Provisional Application No. 62/670,840 filed May 13, 2018, and also claims the benefit under 35 U.S.C. § 119(e) of U.S. Provisional Application No. 62/513,474 filed Jun. 1, 2017, all of which are hereby incorporated by reference.

STATEMENT REGARDING FEDERALLY SPONSORED RESEARCH OR DEVELOPMENT

This invention has been created without the sponsorship or funding of any federally sponsored research or development program.

FIELD OF THE INVENTION

This invention is a device that is used for cutting sheets from rolled paper.

BACKGROUND OF THE INVENTION

Cutting rolled paper is a universal task and tools currently available lead only to universal frustration. The present invention is the universal solution. The outdated way of cutting rolled paper into sheets has never worked very well, because the slice is either jagged, ripped, or crooked. People have been using scissors and EXACTO blades for cutting rolled paper since the 1920s, and these devices are simply not adequate. Current methods and devices waste paper and consumer's time. People have tried blades, knives, and sharper scissors, but those devices are not safe and put the consumer's, including children's, safety in danger. During the holidays, when rolled wrapping paper is most frequently used, and when people have the least amount of time to wrap presents including working with rolled paper, consumers continue to spend hours upon hours fussing with dull scissors and unsafe blades. And ending up with results that are often far from perfect. Without an obvious alternative these appear to the consumer to be the most effective tools for cutting rolled wrapping paper. How we cut wrapping paper needs to change both for efficiencies and for safeties sake.

These and other difficulties experienced with the prior art devices have been obviated in a novel manner by the present invention.

It is, therefore, an outstanding object of some embodiments of the present invention to solve these problems in a simple way. Simply put, the present invention is a large improvement in cutting rolled wrapping paper and provides a device and method that is efficient and effective.

Another object of some embodiments of the present invention is to make cutting rolled wrapping paper easy.

A further object of some embodiments of present invention is to make a monotonous wrapping task fun.

It is another object of some embodiments of the present invention improve the cutting of rolled wrapping paper by making the slice free of jaggedness, ripped sections, or crooked cuts.

It is a further object of some embodiments of the present invention to minimize the wasting of rolled paper as well as minimizing the time needed to actually wrap a package with rolled wrapping paper.

It is another object of some embodiments of the present invention to provide a device that is safe for consumers and particularly for children that often are involved in wrapping present during the holidays.

It is another object of some embodiments of the present invention to provide a device that, during the holidays, when rolled wrapping paper is most frequently used, allows for consumers to spend the least amount of time necessary wrapping presents.

With these and other objects in view, as will be apparent to those skilled in the art, the invention resides in the combination of parts set forth in the specification and covered by the claims appended hereto, it being understood that changes in the precise embodiment of the invention herein disclosed may be made within the scope of what is claimed without departing from the spirit of the invention.

BRIEF SUMMARY OF THE INVENTION

The present invention is a device that is used for cutting sheets from rolled paper. The invention allows users to keep the paper rolled while simultaneously cutting a single sheet of paper safely and with ease. The invention includes a constraining holder for rolled paper, allowing users to engage the embedded cutting blade with an unrolled section of paper to cut off a sheet while simultaneously maintaining control of the paper which remains on the roll. The invention also makes use of a paper cutting blade embedded within a slot to protect the user. The invention furthermore is adjustable to fit varying diameter rolls of paper. The invention works by sliding the device over the paper roll and feeding the paper through a slot in the device. And, once the paper is in the proper position, the user gently pushes the device, producing a cleanly cut slice of paper.

One embodiment of the invention includes a flexible hinge, an embedded blade, a simple construction of durable plastic, a safety lip feature that protects the user's hand from comingt in contact with the sharp cutting blade.

BRIEF DESCRIPTION OF THE DRAWINGS

The character of the invention, however, may best be understood by reference to one of its structural forms, as illustrated by the accompanying drawings, in which.

DETAILED DESCRIPTION OF THE INVENTION

The present invention is a paper cutter device that cuts a sheet from rolled paper. The device is a safety enabled paper cutter that also acts as a tool used to hold rolled paper together, preventing it from unrolling and becoming disorganized.

Figure 1:
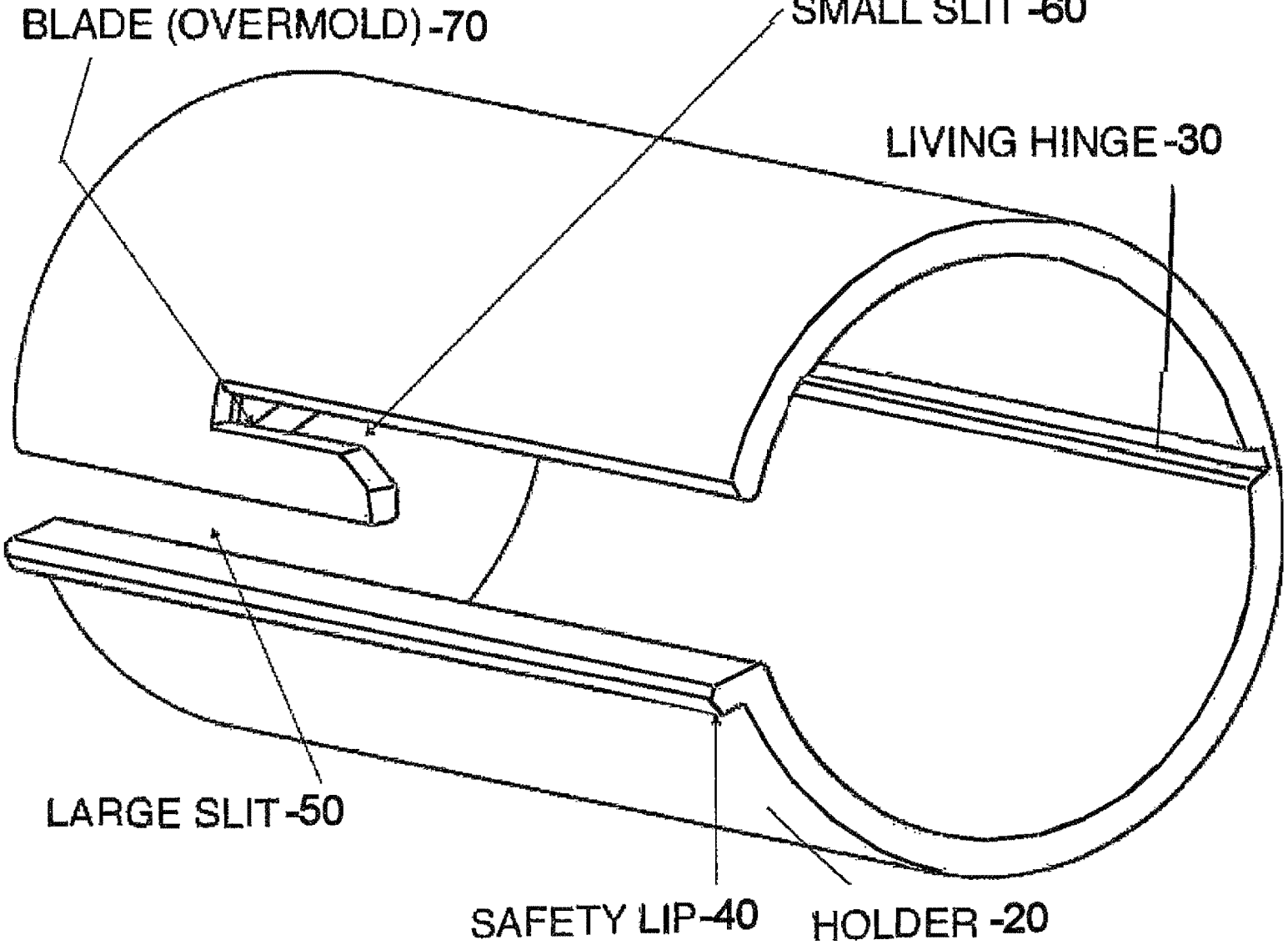
FIG. 1 shows a front view of an emodiment of the present invention including the holder with a front end and back end, the hinge (living), the full length dispensing interstice (large slit), the safety lip, the partial length knife engagement interstice (small slit), and the embedded paper cutting knife blade (overmold).

As shown in FIG. 1, the rolled paper cutter 10 comprises a cylindrical rolled paper holder 20, a full length dispensing interstice (large slit) 50, a partial length knife engagement interstice (small slit) 60, and an embedded paper cutting knife blade 70. The partial length knife engagement interstice (small slit) 60 includes the embedded paper cutting knife blade 70 within it, which knife blade 70 provides the means for slicing the rolled paper 80 and causing the sheet of paper 90 to detache from the rolled paper 80.

The method of cutting rolled paper using the present device includes extending the sheet of paper out to its appropriate length, positioning the holder 20 at the starting end 100 of the rolled paper 80, sliding the edge of the sheet of paper 90 into the partial length knife engagement interstice (small slit) 60, engaging the sheet of paper 90 with the knife blade 70 by moving the paper cutting device 20 forward towards the finish end 110 of the rolled paper 80, while the rolled paper 80 is guided within the partial length knife engagement interstice (small slit) 60, and at the point where the paper cutting device 20 reaches the finish end 110 of the rolled paper 80, cleanly slicing off the sheet of paper 90 from the rolled paper 80.

Figure 2:
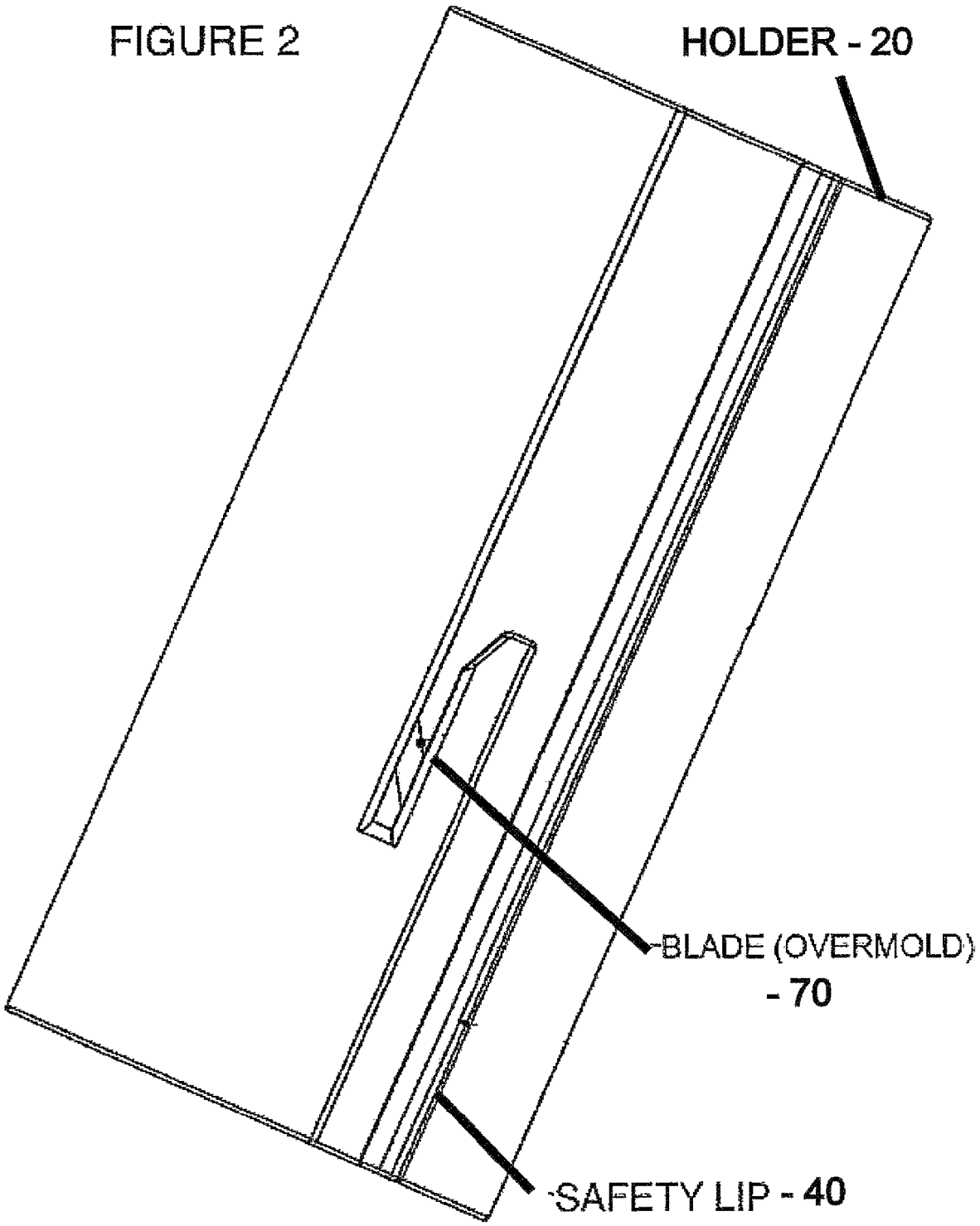
FIG. 2 shows a side view of an embodiment of the present invention including the holder, the safety lip, and the knife blade (overmold)

As shown in FIG. 2, the paper cutter 10 comprises a safety lip 40 that runs parallel to and on the outward facing edge of the full length dispensing interstice (large slit) 50. The full length dispensing interstice (large slit) 50 is the means by which the sheet of paper 90 is properly dispensed and then cut to the appropriate length. There is also a partial length knife engagement interstice (small slit) 60 which acts as a guide for the sheet of paper 90 during the cuttng process.

Figure 3:
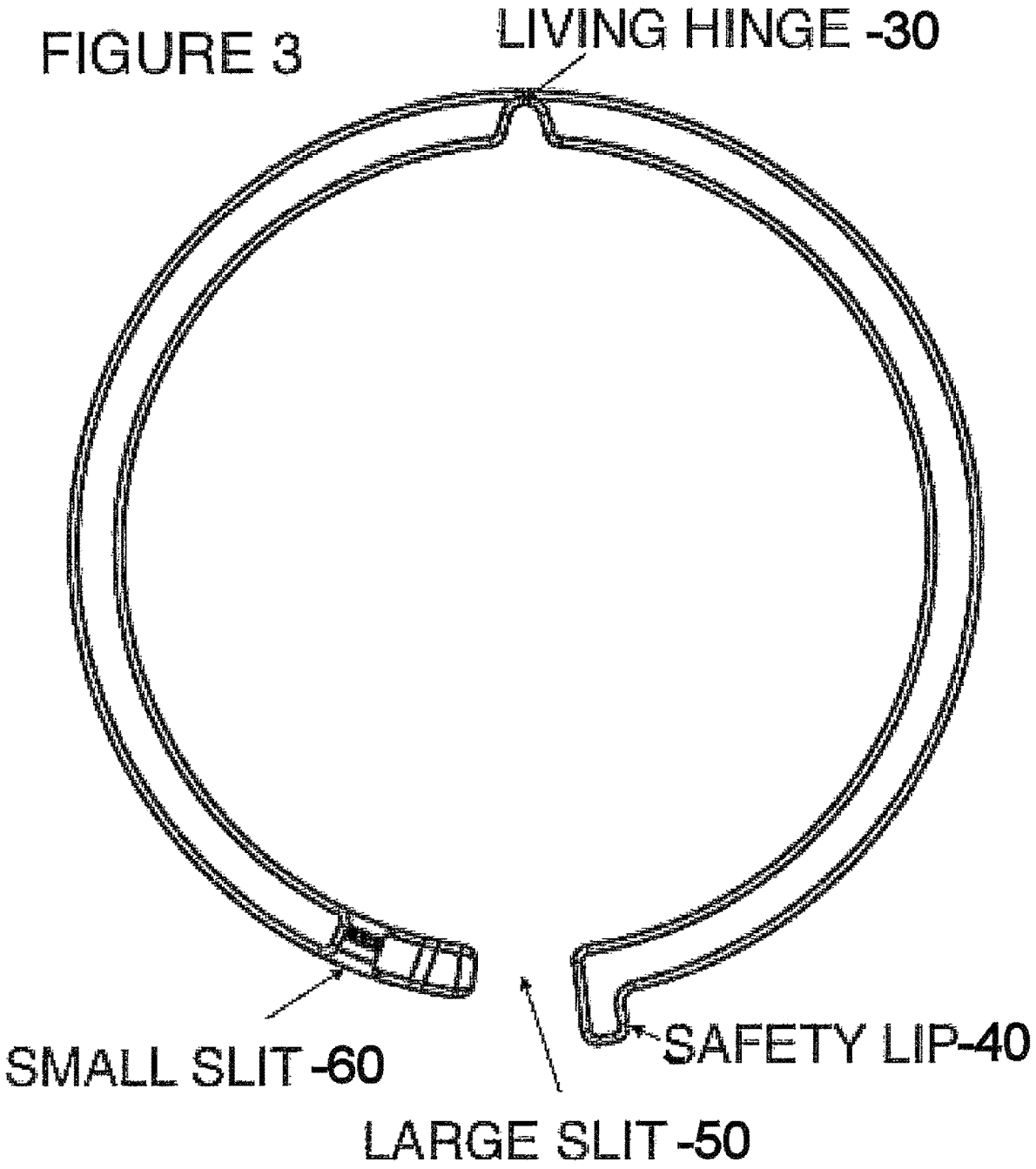
FIG. 3 shows an end view of an embodiment of the present invention including the living hing, the safety lip, the full length dispensing interstice (large slit), and the partial length knife engagement interstice (small slit).

As shown in FIG. 3, the paper cutter device 10 is generally cylindrical which enabling the holder 20 to fit around rolled paper 80 (such as wrapping paper). The holder 20 is able to compress using the hinge (living) 30 in order for it to fit snuggly around the rolled paper even as the circumference of the rolled paper 80 decreases as it is gradually unrolled with use.

To summarize, the rolled paper cutter device 10 allows a user to cut the rolled paper 80 (such as wrapping paper) more effectively, efficiently, and safely.

Figure 4:
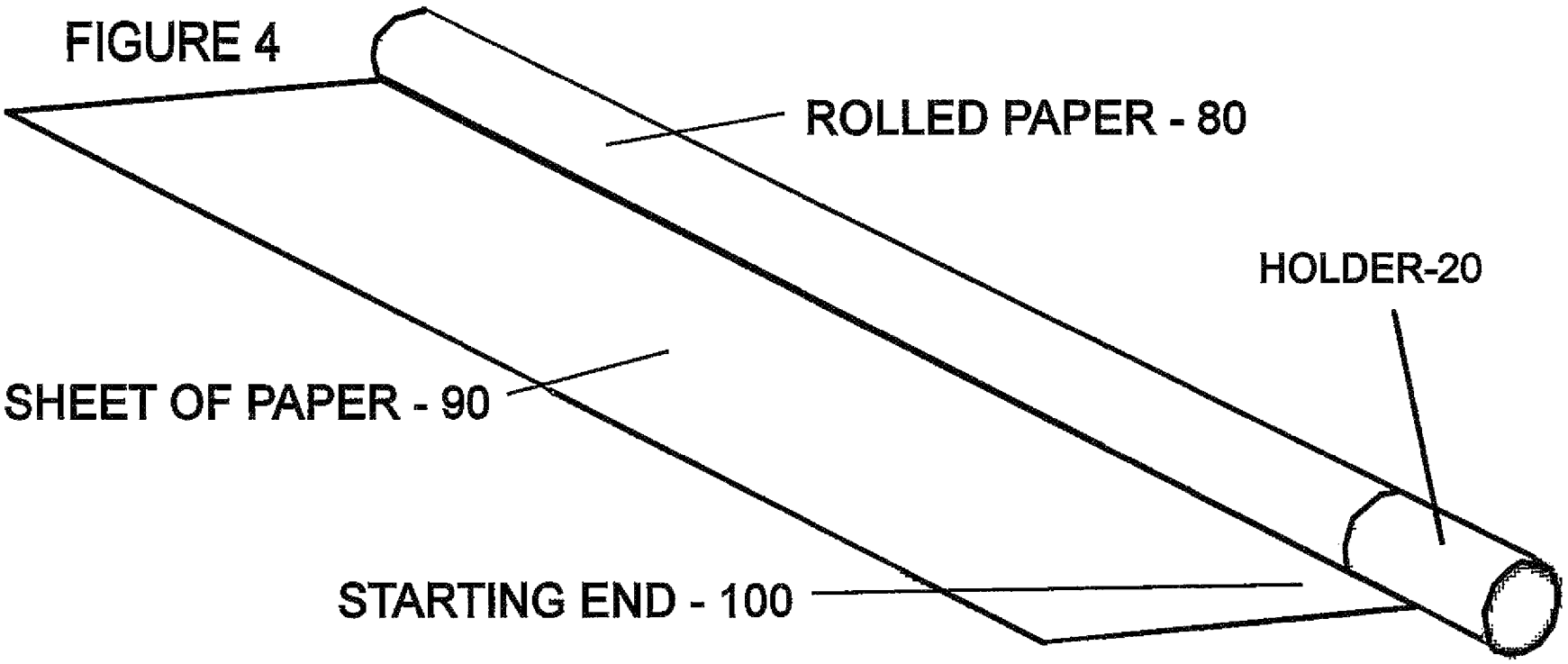
FIG. 4 shows a general view of an embodiment of the present invention with the paper cutting device situated at the starting end of the rolled paper.
Figure 5:
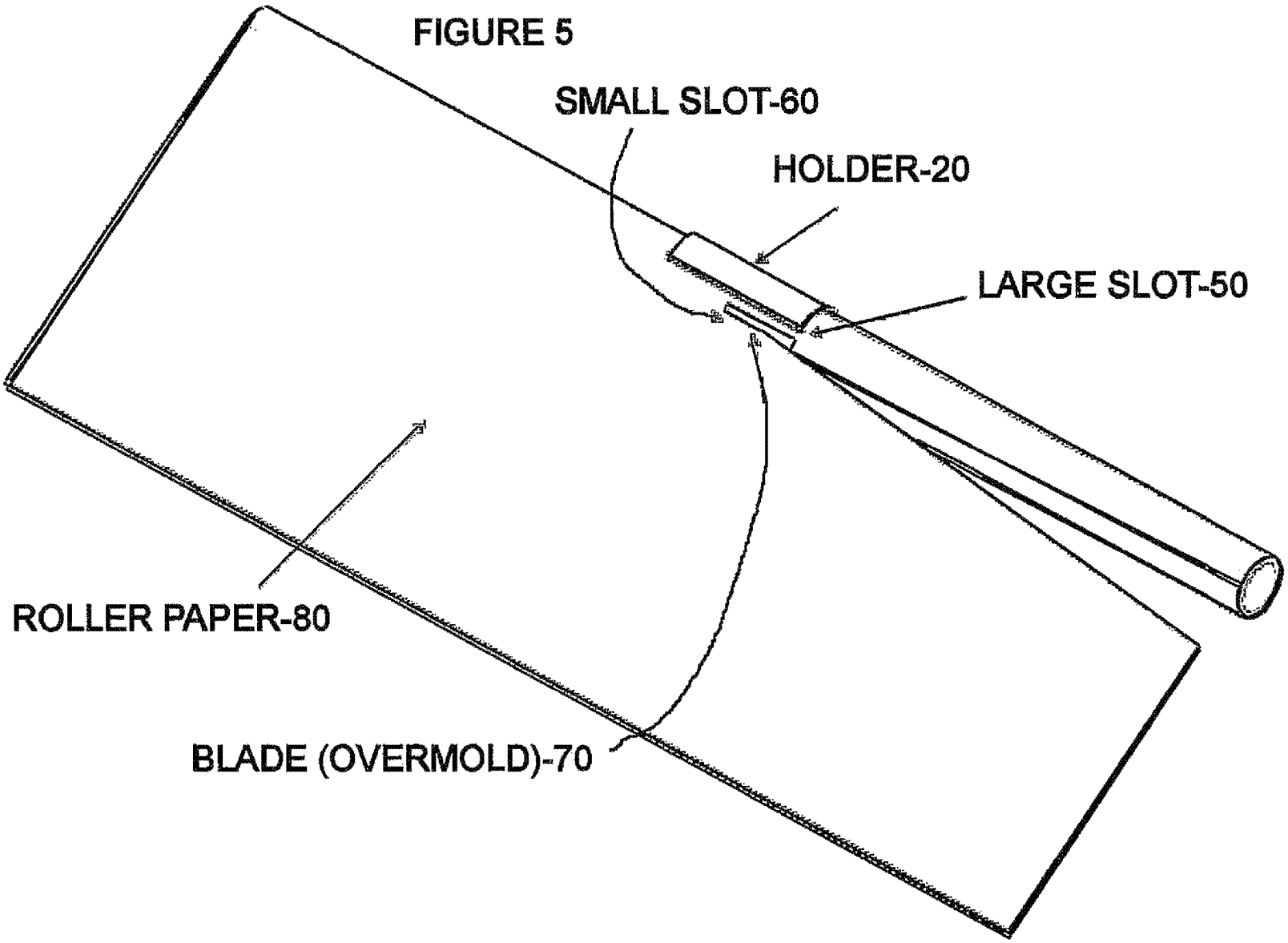
FIG. 5 shows a general view of an embodiment of the present invention with the paper cutting device situated at the midway point of the rolled paper, after having sliced half way through the sheet of paper.
Figure 6:
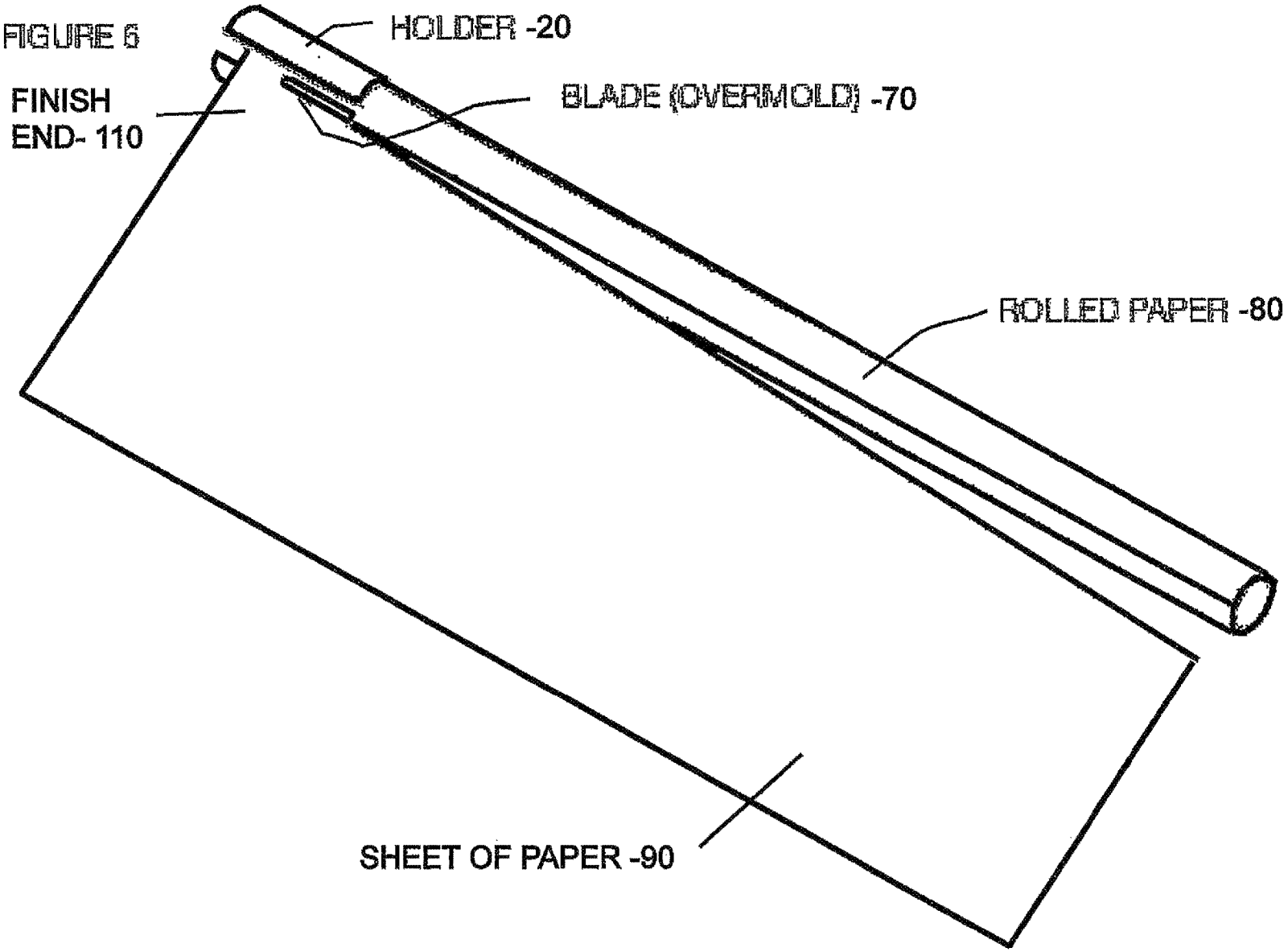
FIG. 6 shows a general view of an embodiment of the present invention showing the paper cutting device situated at the finish end of the rolled paper.

The method of using the rolled paper cutter device 10 involves sliding the paper cutter device 10 over the rolled paper 80 as seen in FIG. 4, FIG. 5, and FIG. 6. The hinge (living) 30 allows the paper cutter device 10 to be useful for variable circumfrences of rolled paper 80. Once the paper cutter device 10 is in place, as shown in FIG. 4, the paper cutter device 10 can be slid over the rolled paper 80.

Once the holder 20 is positioned around the rolled paper 80, as also shown in FIG. 4, the sheet of paper 90 is extended through the full length dispensing interstice (large slit) 50 to the desired length. Following this, the paper cutter device 10 is placed at the starting end 100 of the rolled paper 80 allowing the extended sheet of paper 90 to engage with the partial length knife engagement interstice (small slit) 60 where the knife blade (overmold) 70 is located. In this manner, the sheet of paper 90 is positioned to be cut, with the holder 20 in the starting end 100 of the rolled paper 80 and the sheet of paper 90 engaged with the knife blade (overmold) 70 that is embedded at the closed end of the partial length knife engagement interstice (small slit) 60.

At this point, the holder 20 is moved forward as seen in FIG. 5 and FIG. 6, engaging the sheet of paper 90 with the knife blade 70 which slices the sheet of paper 90 off of the rolled paper 80. As the paper cutter device 10 is slid forward, the sheet of paper 90 comes in contact with the knife blade 70 which causes the sheet of paper 90 to detach from the rolled paper 80. When the sheet of paper 90 is completely disengaged from the rolled paper 80, the paper cutter device 10 having moved from the starting end 100 of the rolled paper 80 to the finish end 110 of the rolled paper 80 and the sheet of paper 90, as shown in FIG. 6, is disengaged from the rolled paper 80.

Finally, the holder 20 is positioned towards the center of the rolled paper 80, so, the paper cutter device 10 thereby provides a convenient means for holding the rolled paper 80 tightly, keeping the paper roll 80 from unravelling, unrolling or becoming disorganized.

The Slot Design

One of the important aspects of this invention is the smooth and consistent manner in which the uncut paper 90 is cut in the slot 60 of the paper cutter 20. As the leading edge 92, of the uncut paper 90 is immobilized by being pressed between the paper cutter 20 and the rolled paper 80, and is fed into the slot 60, the leading edge 92 is fed to the lower edge 62 of the slot 60 by the funnel shaped element 64 at the opening 66 of the slot 60. As the leading edge 92 of the uncut paper 90 passes along the slot 60, the leading edge 92 of the uncut paper 90 tends to stay against the lower edge 62 of the slot 60 and therefore first touches the forward edge 72 o f the blade 70. As a result, the leading edge 92 of the sheet of paper 90 contacts the forward edge 72 of the blade 70 and the leading edge 92 of the uncut paper 90 and is pushed against and slides along the blade edge 74, toward the back 76 of the blade 70. The result is that the sliding contact between the leading edge 92 of the uncut paper 90 and the blade edge 74 results in a "saw action" even though the blade is relatively sharp and smooth. This is because, no matter how carefully the sharp edge of the blade is prepared, it necessarily has some microscopic imperfections which saw the uncut paper 90 as the leading edge 92 of the paper moves upward along the blade edge 74. Ideally, the leading edge 92 of the paper 90 is fully cut a short distance along the sharp edge 74 of the blade 70, but it is normally and consistently cut before it reaches the upper end 78 of the blade edge 74. Thus, as the paper cutter 20 moves axially along the roll 80, the leading edge 92 of the sheet of paper 90 is separated from the roll 80, and of the sheet of paper 90 is smoothly and completely separated from the roll 80.

Figure 7:
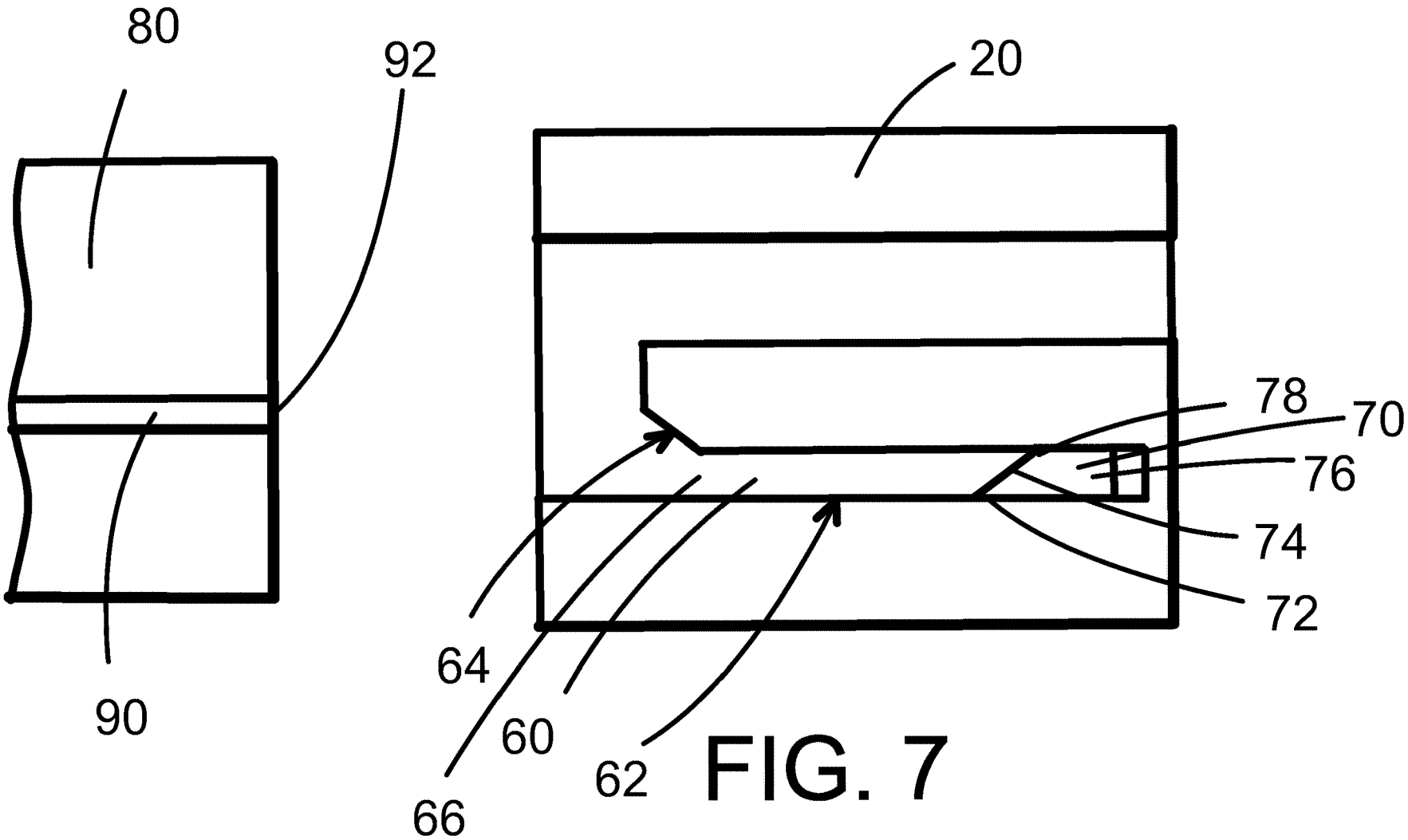
FIG. 7 shows the roll of paper and the paper cutter separated from one another and prior to the process of cutting a sheet of paper off of the roll.

More specifically, FIG. 7 shows the roll of paper and the paper cutter separated from one another and prior to the process of cutting a sheet of paper off of the roll.

Figure 8:
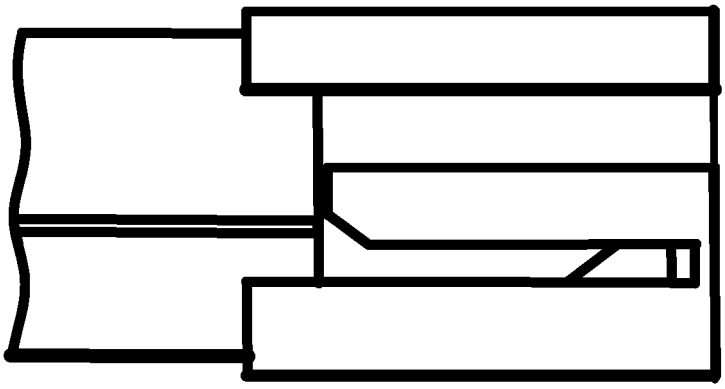
FIG. 8 shows the roll of paper as it enters the paper cutter and before the forward edge of the paper contacts the funnel shaped element at the opening of the slot.

FIG. 8 shows the roll of paper as it enters the paper cutter and before the forward edge of the paper contacts the funnel shaped element at the opening of the slot.

Figure 9:
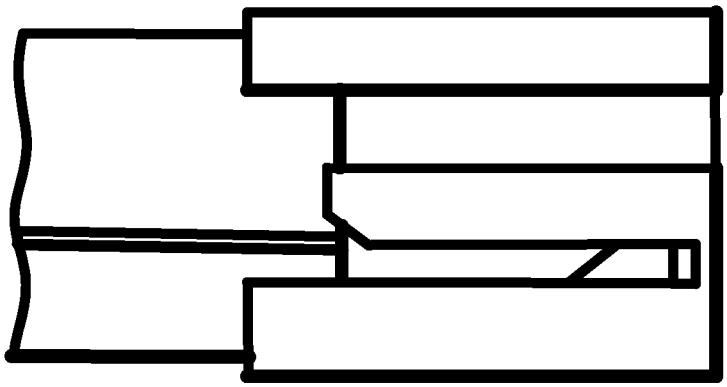
FIG. 9 shows the roll of paper as it enters the paper cutter and as the forward edge of the paper contacts the funnel shaped element at the opening of the slot, and is fed into the slot.

FIG. 9 shows the roll of paper as it enters the paper cutter and as the forward edge of the paper contacts the funnel shaped element at the opening of the slot, and is fed into the slot.

Figure 10:
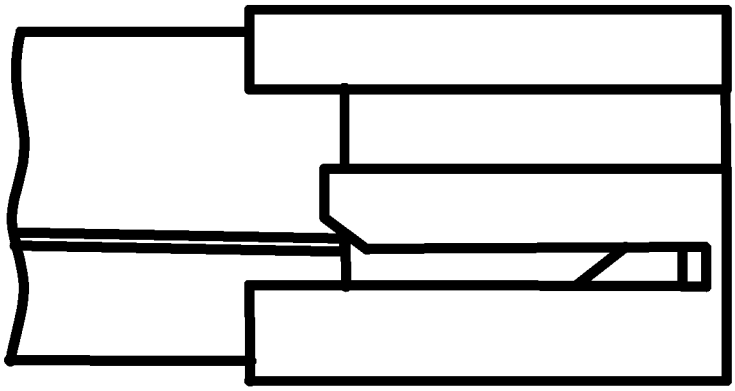
FIG. 10 shows the roll of paper as it further enters the paper cutter and as the forward edge of the paper contacts the funnel shaped element at the opening of the slot, and is further fed into the slot.

FIG. 10 shows the roll of paper as it further enters the paper cutter and as the forward edge of the paper contacts the funnel shaped element at the opening of the slot, and is further fed into the slot.

Figure 11:
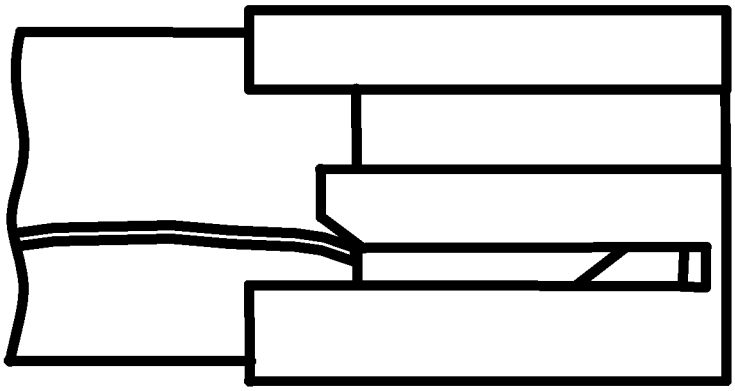
FIG. 11 shows the roll of paper as it further enters the paper cutter and as the forward edge of the paper contacts the funnel shaped element at the opening of the slot, and is further fed into the slot.

FIG. 11 shows the roll of paper as it further enters the paper cutter and as the forward edge of the paper contacts the funnel shaped element at the opening of the slot, and is further fed into the slot.

Figure 12:
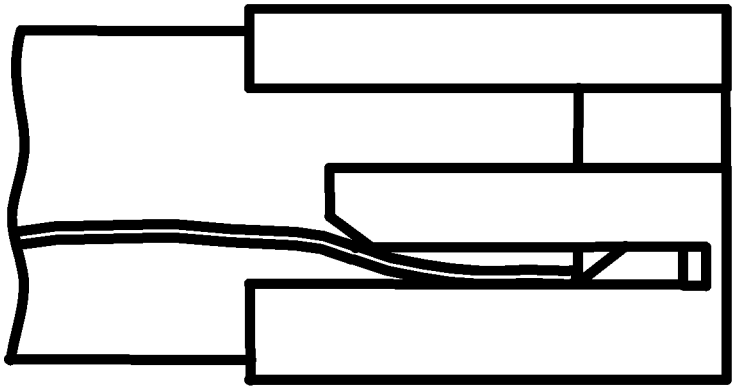
FIG. 12 shows the roll of paper as it even further enters the paper cutter and as the forward edge of the paper contacts the funnel shaped element at the opening of the slot, and is even further fed into the slot, and contacts the cutting blade.

FIG. 12 shows the roll of paper as it even further enters the paper cutter and as the forward edge of the paper contacts the funnel shaped element at the opening of the slot, and is even further fed into the slot, and contacts the cutting blade.

Figure 13:
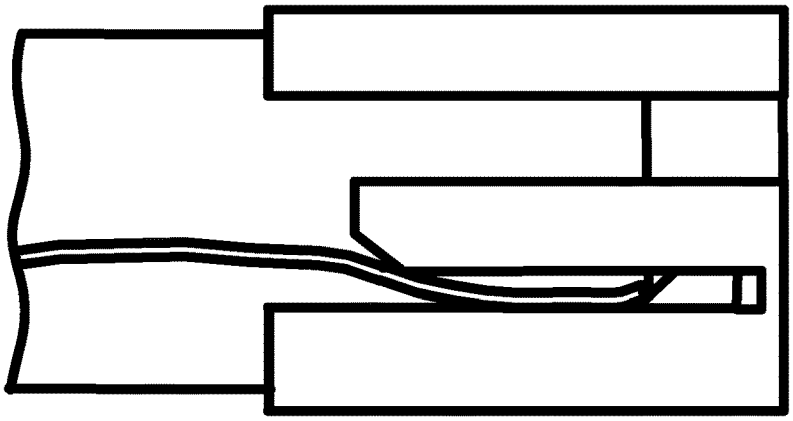
FIG. 13 shows the roll of paper as it even further enters the paper cutter and as the forward edge of the paper contacts the funnel shaped element at the opening of the slot, and is even further fed into the slot, and begins to be cut by the cutting blade.

FIG. 13 shows the roll of paper as it even further enters the paper cutter and as the forward edge of the paper contacts the funnel shaped element at the opening of the slot, and is even further fed into the slot, and begins to be cut by the cutting blade.

Figure 14:
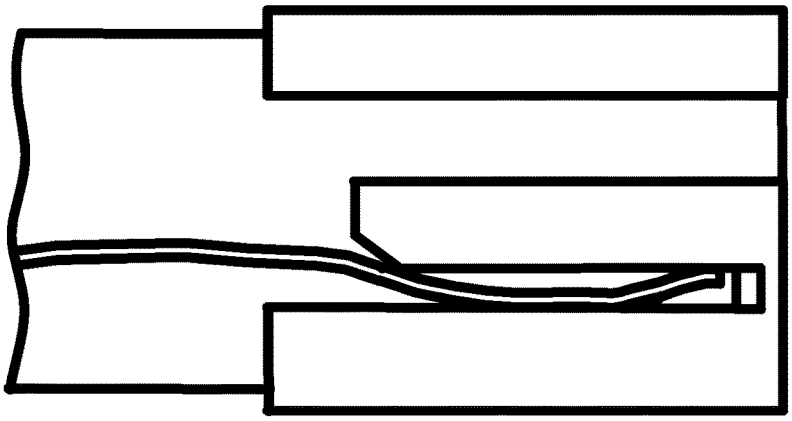
FIG. 14 shows the roll of paper as it even further enters the paper cutter and as the forward edge of the paper contacts the funnel shaped element at the opening of the slot, and is even further fed into the slot, and is substantially cut by the cutting blade.

FIG. 14 shows the roll of paper as it even further enters the paper cutter and as the forward edge of the paper contacts the funnel shaped element at the opening of the slot, and is even further fed into the slot, and is substantially cut by the cutting blade.

Figure 15:
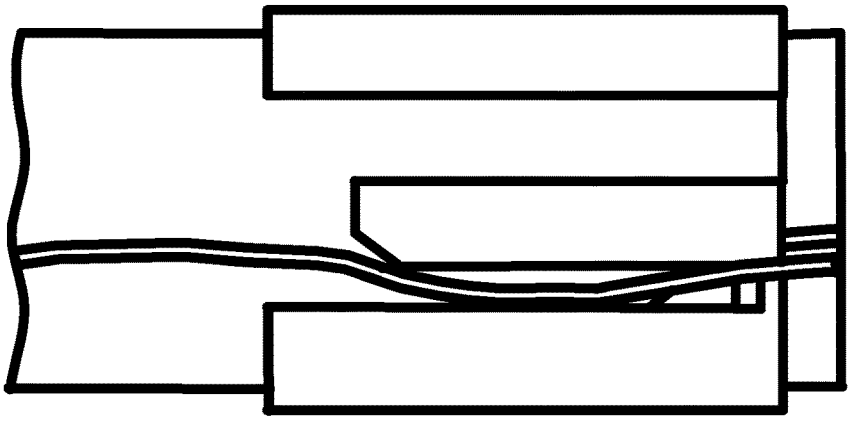
FIG. 15 shows the roll of paper as emerges from the paper cutter. It can be seen that a sheet of paper is being partially split off of the roll.

FIG. 15 shows the roll of paper as emerges from the paper cutter. It can be seen that a sheet of paper is being partially split off of the roll. The split off continues as the paper cutter moved to the left along the roll of paper. Eventually, paper cutter will come off of the paper roll, and the sheet to paper will be completely and neatly severed from the paper roll.

Variation in the Slot Design

It has been found that the smooth and consistently perfect cutting of the sheet of paper 90 can be further enhanced by a variation in the profile of the cutting slot.

Figure 16:
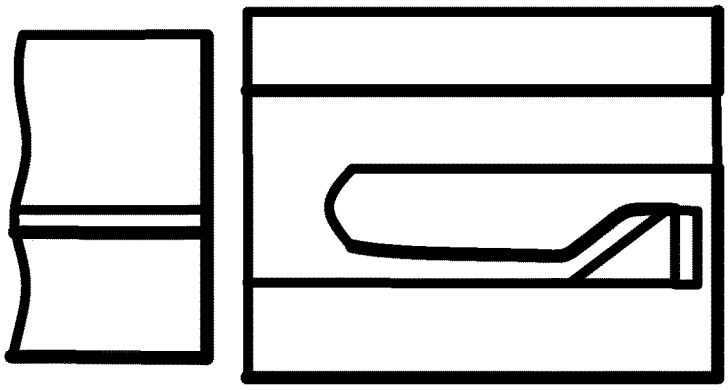
FIG. 16, shows a variation of the paper cutter shown in FIG. 7. The modification is an enlargement of the blade chamber at the blade end of the slot 60 to form the modified slot 60A. Preferably, the depth of the slot 60A is narrower than the slot 60, in order guide the leading each of the paper even more reliably into contact with lowest point on the blade.

FIG. 16, shows a variation of the paper cutter shown in FIG. 7. The modification is an enlargement of the blade chamber at the blade end of the slot 60 to form the modified slot 60A. Preferably, the depth of the slot 60A is narrower than the slot 60, in order guide the leading each of the paper even more reliably into contact with lowest point on the blade. Then, because the broadened blade chamber allows a longer length blade edge to be exposed, the certainty of the paper being fully severed before it reaches the upper end of the blade edge is end increased. This allows the paper cutter to be more reliable on more difficult-to-cut paper. It also extends the effective life of the paper cutter, since, as the blade dulls, there is extra length of the blade edge to complete the paper severing function.

More specifically, FIG. 16 shows the roll of paper and the paper cutter separated from one another and prior to the process of cutting a sheet of paper off of the roll.

Figure 17:
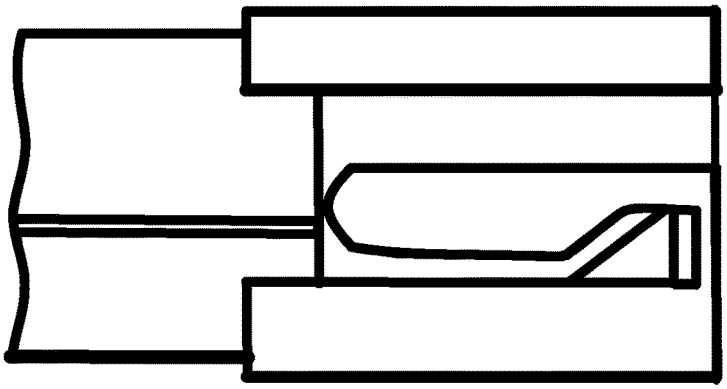
FIG. 17 shows the roll of paper as it enters the paper cutter and before the forward edge of the paper contacts the funnel shaped element at the opening of the slot.

FIG. 17 shows the roll of paper as it enters the paper cutter and before the forward edge of the paper contacts the funnel shaped element at the opening of the slot.

Figure 18:
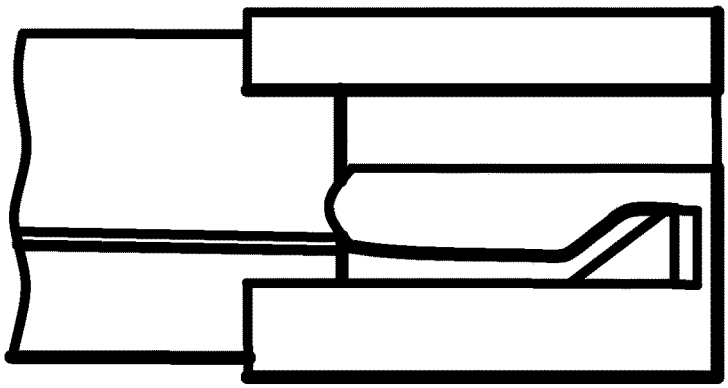
FIG. 18 shows the roll of paper as it enters the paper cutter and as the forward edge of the paper contacts the funnel shaped element at the opening of the slot, and is fed into the slot.

FIG. 18 shows the roll of paper as it enters the paper cutter and as the forward edge of the paper contacts the funnel shaped element at the opening of the slot, and is fed into the slot.

Figure 19:
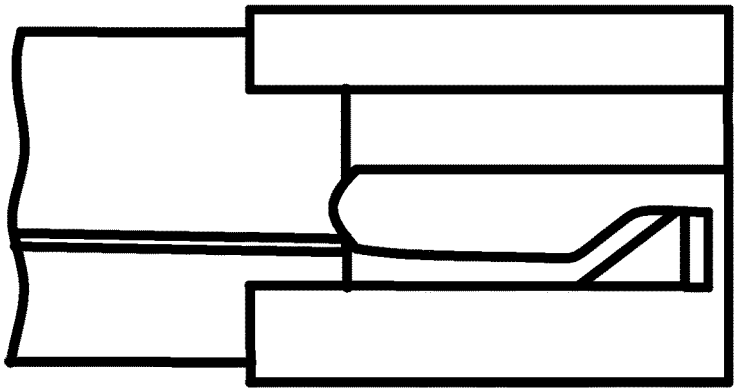
FIG. 19 shows the roll of paper as it further enters the paper cutter and as the forward edge of the paper contacts the funnel shaped element at the opening of the slot, and is further fed into the slot.

FIG. 19 shows the roll of paper as it further enters the paper cutter and as the forward edge of the paper contacts the funnel shaped element at the opening of the slot, and is further fed into the slot.

Figure 20:
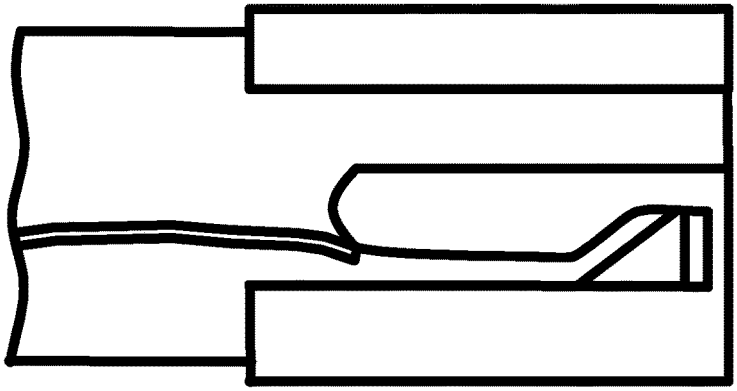
FIG. 20 shows the roll of paper as it further enters the paper cutter and as the forward edge of the paper contacts the funnel shaped element at the opening of the slot, and is further fed into the slot.

FIG. 20 shows the roll of paper as it further enters the paper cutter and as the forward edge of the paper contacts the funnel shaped element at the opening of the slot, and is further fed into the slot.

Figure 21:
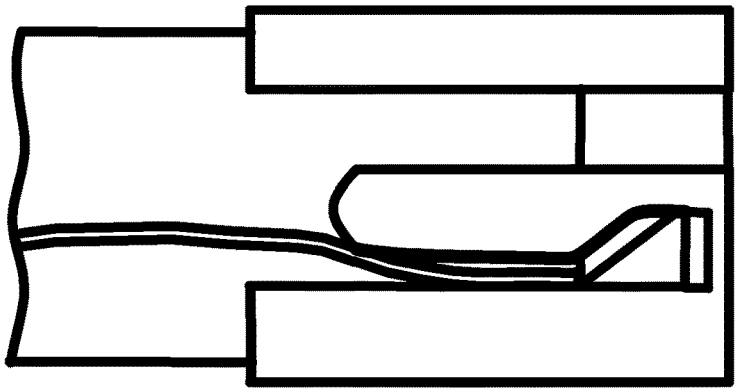
FIG. 21 shows the roll of paper as it even further enters the paper cutter and as the forward edge of the paper contacts the funnel shaped element at the opening of the slot, and is even further fed into the slot, and contacts the cutting blade.

FIG. 21 shows the roll of paper as it even further enters the paper cutter and as the forward edge of the paper contacts the funnel shaped element at the opening of the slot, and is even further fed into the slot, and contacts the cutting blade.

Figure 22:
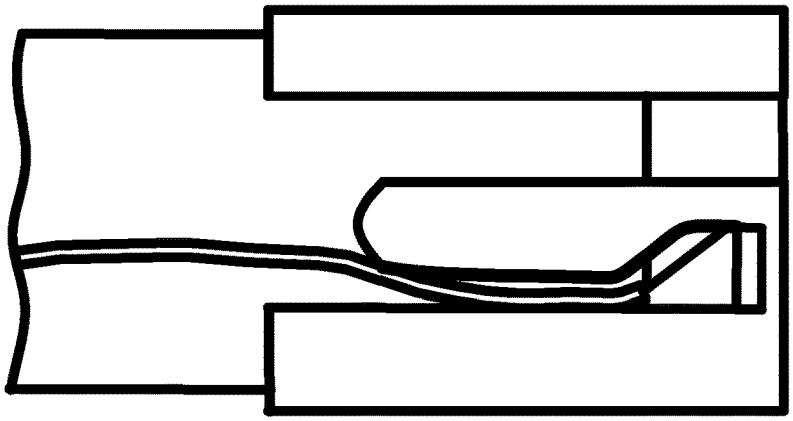
FIG. 22 shows the roll of paper as it even further enters the paper cutter and as the forward edge of the paper contacts the funnel shaped element at the opening of the slot, and is even further fed into the slot, and begins to be cut by the cutting blade.

FIG. 22 shows the roll of paper as it even further enters the paper cutter and as the forward edge of the paper contacts the funnel shaped element at the opening of the slot, and is even further fed into the slot, and begins to be cut by the cutting blade.

Figure 23:
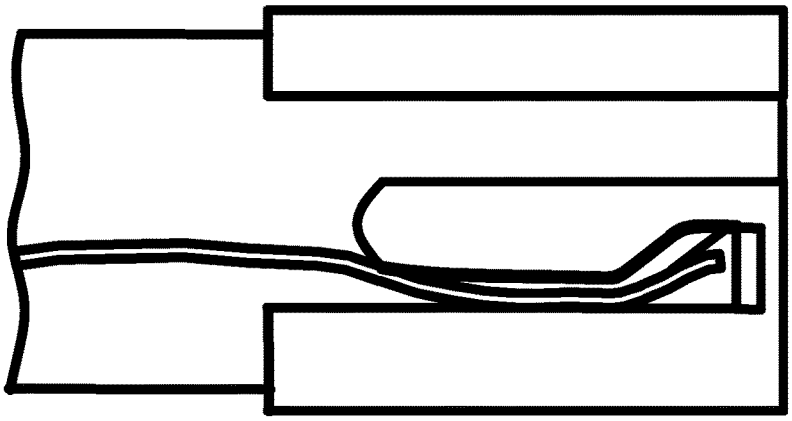
FIG. 23 shows the roll of paper as it even further enters the paper cutter and as the forward edge of the paper contacts the funnel shaped element at the opening of the slot, and is even further fed into the slot, and is substantially cut by the cutting blade.

FIG. 23 shows the roll of paper as it even further enters the paper cutter and as the forward edge of the paper contacts the funnel shaped element at the opening of the slot, and is even further fed into the slot, and is substantially cut by the cutting blade.

Figure 24:
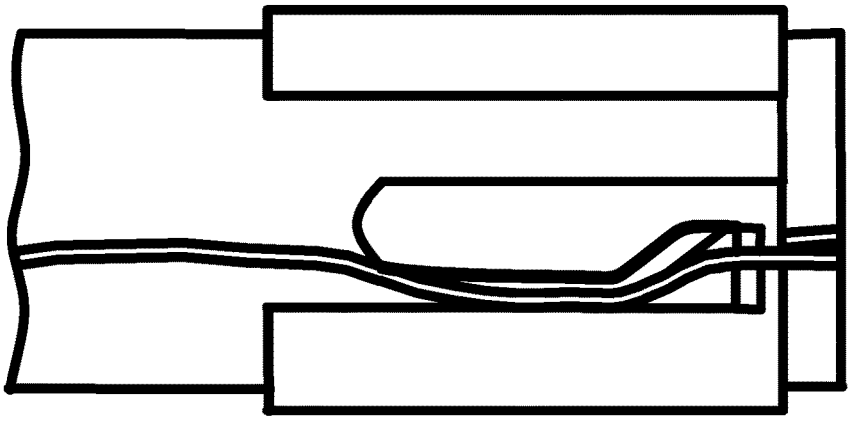
FIG. 24 shows the roll of paper as emerges from the paper cutter. It can be seen that a sheet of paper is being partially split off of the roll. The split off continues as the patter cutter moved to the left along the roll of paper. Eventually, paper cutter will come off of the paper roll, and the sheet to paper will be completely and neatly severed from the paper roll.

FIG. 24 shows the roll of paper as emerges from the paper cutter. It can be seen that a sheet of paper is being partially split off of the roll. The split off continues as the patter cutter moved to the left along the roll of paper. Eventually, paper cutter will come off of the paper roll, and the sheet to paper will be completely and neatly severed from the paper roll.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desire to secure by Letters Patent is:

1. A paper cutting device comprising:

a. a tube configured to receive an elongated section of a roll of paper within a hollow interior thereof, said tube having an open front end, an open back end and a middle section between the front end and the back end defining a length thereof; and having a top portion and a bottom portion bounding the hollow interior between the open front end and open back end of the tube, the portions separated from each other by a full length dispensing interstice on one side and a hinge on the other side;

b. the full length dispensing interstice running axially along one side of the tube from the front end to the back end, and defining an elongated gap between a first edge of the top portion of the tube and a first edge of the bottom portion of the tube;

c. the hinge configured to pivot the top portion of the tube with respect to the bottom portion responsive to compressive pressure applied by a user to exterior surfaces of top and bottom portions of the tube to thereby decrease a spacing distance between the first edge of the top portion and first edge of the bottom portion of the tube, said hinge running axially along one side of the tube from the front end to the back end and running parallel to the full length dispensing interstice and defining a second edge of the top portion of the tube and a second edge of the bottom portion of the tube;

d. a paper cutting knife blade attached to the first edge of the bottom portion of the tube, between the front end and the back end, and extending into the elongated gap only partially between the first edge of the top portion of the tube and a first edge of the bottom portion of the tube, the knife blade including a sharp edge which that faces towards the front end of the tube.

2. A paper cutting device as recited in claim 1, further including a safety lip protruding substantially perpendicular to and extending along an entire length of an outward facing edge of the first edge of the top portion of the tube.

3. A paper cutting device as recited in claim 1 further comprising a partial length knife engagement interstice parallel to the full length dispensing interstice and to extending partially into the elongated gap between the first edge of the top portion and the first edge of the bottom portion, said partial length knife engagement interstice being open towards the front end of the device and closed towards the back facing end, the front facing blade is attached at the back end, and the partial length knife engagement interstice is a paper cutting guide.

4. A paper cutting device as recited in claim 1 wherein the hinge is a living hinge.

5. A method of cutting rolled paper into sheets of paper A method of cutting rolled paper into sheets of paper comprising the steps of:

a. using a paper cutting device comprising: a tube having an open front end, an open back end and a middle section between the front end and the back end, and having a top portion and a bottom portion separated from each other by a full length dispensing interstice on one side of the tube and a hinge on the other side of the tube, the full length dispensing interstice running axially along one side of the tube from the front end to the back end, and defined by a first edge of the top portion of the tube and a first edge of the bottom portion of the tube, the hinge running axially along one side of the tube from the front end to the back end and running parallel to the full length dispensing interstice, the hinge defining a second edge of the top portion of the tube and a second edge of the bottom portion of the tube, the hinge allowing for variations in a width of the interstice when the top portion of the tube is pivoted about the axis of the hinge; a knife blade extending partially into the interstice includes a sharp edge which faces toward the front end of the tube and is attached to the first edge of the bottom portion of the tube, between the front end and the back end of the tube;

b. positioning the paper cutting device around the rolled paper;

c. extending a free end of the rolled paper through the full length paper dispensing interstice to a desired length to present a side edge of the free end of the rolled paper to the knife blade;

d. engaging the side edge of the free end of the rolled paper with the knife blade;

e. moving the paper cutting device in a direction perpendicular to the side edge to cut the free end from a remaining portion of the rolled paper with the knife blade; and f. detaching the free end of the rolled paper from the rolled paper.

6. The method of claim 5, wherein the step of positioning the paper cutting device around the rolled paper includes positioning the paper cutting device around the rolled paper along an entire length of the paper cutting device from the front end to the back end.

7. The method of claim 6, where the step of extending a free end of the rolled paper through the full length paper dispensing interstice includes extending a free end of the rolled paper through an entire length of the paper dispensing interstice from the front end to the back end.

8. The method of claim 5, further including the steps of:

applying compressive pressure to exterior surfaces of top and bottom portions; and pivoting a top portion of the tube around the hinge with respect to a bottom portion to thereby decrease a dimension of a separation between the top and bottom portion.

9. The method of claim 5, wherein the step of positioning the paper cutting device around the rolled paper includes positioning so that the rolled paper extends out both the open front end and open back end of the paper cutting device.

10. A rolled paper cutting device comprising:

an elongated, generally cylindrical body having an interior expanse bound by open front and back ends and interior surfaces of the generally cylindrical body, further having an elongated slit dividing a sidewall of the body into top and bottom portions and spanning between the open front and back ends, the top and bottom portions for allowing unimpeded access from the interior expanse through the elongated slit to an exterior of the device, said interior expanse being configured to receive rolled paper therein and dispense a desired length of the rolled paper perpendicular to a long axis of the rolled paper through the elongated slit;

a knife supporting member partially extending in the elongated slit, a knife engagement interstice extending into the elongated slit between the top portion of the body and the knife supporting member defining a second slit; and a cutting blade embedded within the in the second slit and having a cutting surface aligned with a long axis of the second slit and facing a paper receiving end of the second slit.

11. The rolled paper cutting device of claim 10, further comprising a living hinge running axially along one side of the generally cylindrical body from the front end to the back end and running parallel to and spaced from the elongated slit, the hinge configured to pivot the top portion of the body with respect to the bottom portion responsive to compressive pressure applied by a user to exterior surfaces of top and bottom portions of the body to thereby decrease a dimension of the interior expanse and retaining the rolled paper as the rolled paper is unrolled and dispensed through the elongated slit.

12. The rolled paper cutting device of claim 10, further including a safety lip protruding substantially perpendicular to and extending along an entire length of an outward facing edge adjacent the bottom portion of the generally cylindrical body.

13. The rolled paper cutting device of claim 10, wherein the second slit and elongated slit run parallel to one another.

14. The rolled paper cutting device of claim 10, where the knife engagement interstice includes a closed rear end adjacent the back end of the generally cylindrical body, the cutting blade embedded adjacent the rear end.

* * * * *